US005231383A

United States Patent [19]

Diepstraten et al.

[11] Patent Number: 5,231,383

[45] Date of Patent: Jul. 27, 1993

[54] VIDEOGRAPHICS DISPLAY SYSTEM

[75] Inventors: Wilhelmus J. M. Diepstraten, VL Diessen; Peter P. ten Hoeve, LT Nijkerk, both of Netherlands

[73] Assignee: NCR Corporation, Dayton, Ohio

[21] Appl. No.: 674,245

[22] Filed: Mar. 25, 1991

[30] Foreign Application Priority Data

Dec. 20, 1990 [GB] United Kingdom ..... 9027678

[51] Int. Cl.[5] ..... G09G 1/02

[52] U.S. Cl. ..... 340/799; 340/750

[58] Field of Search ..... 340/799, 769, 750, 723, 340/747, 798, 751; 365/193

[56] References Cited

U.S. PATENT DOCUMENTS

| | | | |
|---|---|---|---|
| 4,189,727 | 2/1980 | Vaughn, Jr. | 340/799 |
| 4,482,979 | 11/1984 | Mary | 340/709 |
| 4,608,632 | 8/1986 | Kummer | 340/750 |
| 4,642,626 | 2/1987 | Bruce | 340/750 |
| 4,646,078 | 2/1987 | Knierim et al. | 340/747 |
| 4,692,759 | 9/1987 | Phan Van Cang | 340/750 |
| 4,757,312 | 7/1988 | Asai et al. | 340/751 |
| 4,918,429 | 4/1990 | Clarke | 340/798 |
| 5,097,256 | 3/1992 | Eldridge et al. | 340/799 |

FOREIGN PATENT DOCUMENTS

| | | |
|---|---|---|
| 0241288 | 4/1987 | European Pat. Off. . |
| 0279860 | 7/1987 | European Pat. Off. . |

*Primary Examiner*—Alvin E. Oberley
*Assistant Examiner*—Regina Liang
*Attorney, Agent, or Firm*—Richard W. Lavin

[57] ABSTRACT

A videographics display system includes a graphics processor and a video RAM memory including a first portion storing video information and a second portion which is utilized for non-video information such as program information, message buffers, font tables, etc. The second portion includes dispersed memory regions formed by row portions which are not used for video information. The system includes multiplexing means effective to address the second memory portion by contiguous addresses.

3 Claims, 6 Drawing Sheets 104
106
108
110
28
A17
(A16)
RAS
120
SW8A (7A)
124
A8
(A7)
122
CAS
126
NORM
SW8C (7C)
128
(RA7)
RA8
142
144
A15
(A14)
RAS
130
SW8B (7B)
CONT
140
+5V
134
132
CAS
136
138
114
RAS/ , CAS/
112
NORM / CONT
MODE 104
106
108
110
28
A15
(A14 : A9)
RAS
150
SW6A (5A : 0A)
154
A6
(A5 : A0)
152
CAS
156
NORM
SW6C (5C : 0C)
158
(RA5 : RA0)
RA6
170
172
A13
(A12 : A7)
RAS
160
SW6B (5B : OB)
CONT
168
164
166
A6
(A5 : A0)
162
CAS
114
RAS/ , CAS/
112
NORM / CONT
MODE

VIDEOGRAPHICS DISPLAY SYSTEM

BACKGROUND OF THE INVENTION

The present invention relates to videographics display systems of the kind including processing means adapted to control the operation of said display systems, a video random access memory means adapted to store video data to be displayed and monitor means adapted to provide a visual display of the stored data.

In present day computer systems using a videographics display monitor, a high degree of processing power is needed to control the displays, for example when window type or other complex displays are provided. Thus, dedicated graphics processors have become available which unburden the main system processor from much of the processing needed for the information to be displayed on the monitor screen. Also, such computer systems generally utilize commercially available video random access memories (VRAMs) formed of a plurality of VRAM integrated circuit chips. Each chip includes a DRAM (Dynamic Random Access Memory) array and a shift register. An entire row of data is latched into the shift register, leaving the DRAM array free for read/write operations to occur independently of the shift register, which can be used to clock out the data. The shift register may be clocked out at high (video) speed to refresh the monitor screen. VRAM devices available include one Mbit (1 Megabit) devices, arranged as 512 rows by 512 columns, with each column location storing 4 bits. Other sizes of VRAM devices, such as 256 Kbit devices are also available. In addition to the VRAM memory devices for video information, the graphics processor also requires additional storage for program information and for message buffers, font tables, etc. The provision of storage for the graphics processor is a significant cost item for a videographics display system.

SUMMARY OF THE INVENTION

There is provided a videographics display system, including processing means adapted to control the operation of said display system, video random access memory means adapted to store video data to be displayed, and monitor means adapted to provide a visual display of the stored data, characterized by memory control means coupled to said processing means and to said memory means and adapted to address said memory means in a first mode to access a first portion of said memory means and in a second mode to access a second portion of said memory means which is adapted to store non-video data, wherein said second portion includes storage locations disposed in a plurality of dispersed storage regions in said memory means, and wherein said memory control means is adapted to address said second portion of said memory means by contiguous addresses. It will be appreciated that a videographics display system according to the present invention achieves a cost reduction since the need for additional RAM storage is reduced or eliminated by virtue of the efficient utilization of the VRAM memory.

It is thus an object of the present invention to provide a low cost videographics display system.

BRIEF DESCRIPTION OF THE DRAWINGS

Additional advantages and meritorious features of the present invention will be apparent from the following detailed description and appended claims when read in conjunction with the drawings wherein like numerals identify corresponding elements.

DETAILED DESCRIPTION OF THE PREFERRED EMBODIMENT

Figure 1:
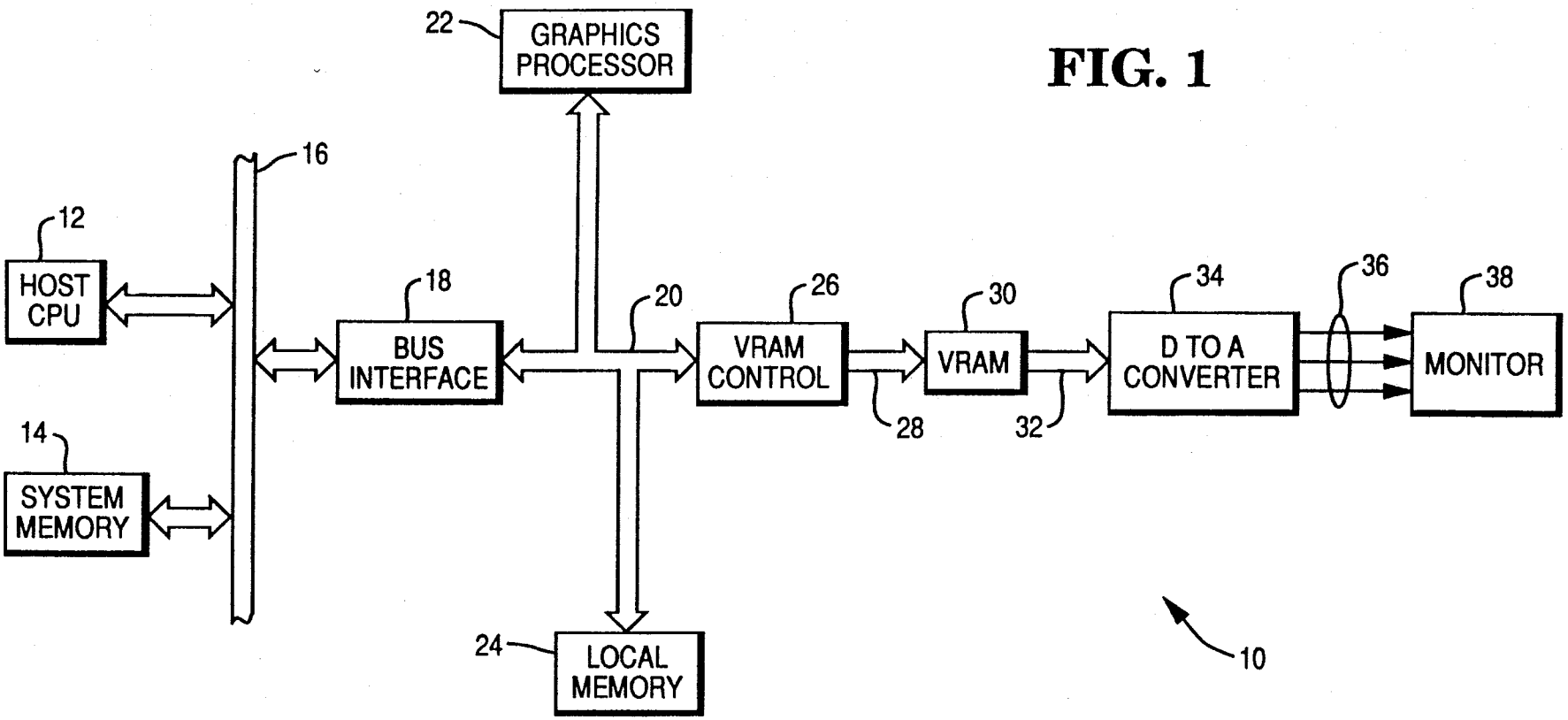
FIG. 1 is a block diagram of a videographics display system.

Referring now to FIG. 1, there is shown a block diagram of a videographics display system generally indicated by the numeral 10. The videographics display system 10 includes a host CPU 12 and a system memory 14, both coupled to a system bus 16. The system bus 16 is connected via a bus interface unit 18 to a 16-bit local bus 20. Also connected to the local bus 20 are a graphics processor 22, a local memory 24 (which may include a RAM and a ROM) adapted to store program and data information and a VRAM control circuit 26, which is connected via a bus 28 to a VRAM memory unit 30. The VRAM memory unit 30 has an output bus 32 which is connected to a RAMDAC type digital-to-analog converter 34 having three output lines 36 for the R, G and B signals, connected to a color monitor screen 38.

It should be understood that the VRAM memory unit 30 contains a plurality of individual VRAM integrated circuit devices such as the NEC UPD41264 VRAM chip. The precise number and interconnection of such chips is dependent on the particular application and type of monitor screen, and since it is not pertinent to the present invention, this aspect will not be described in detail herein. The VRAM chips utilized in the preferred embodiment are preferably one Mbit devices.

The graphics processor 22 may be, for example, a Texas Instruments TMS 34010 graphics processor. With such a graphics processor, the display pitch, that is, the difference in memory addresses between two pixels that appear in vertically adjacent positions on the screen must be a power of two in order to support XY addressing of pixels on the screen.

Figure 2:
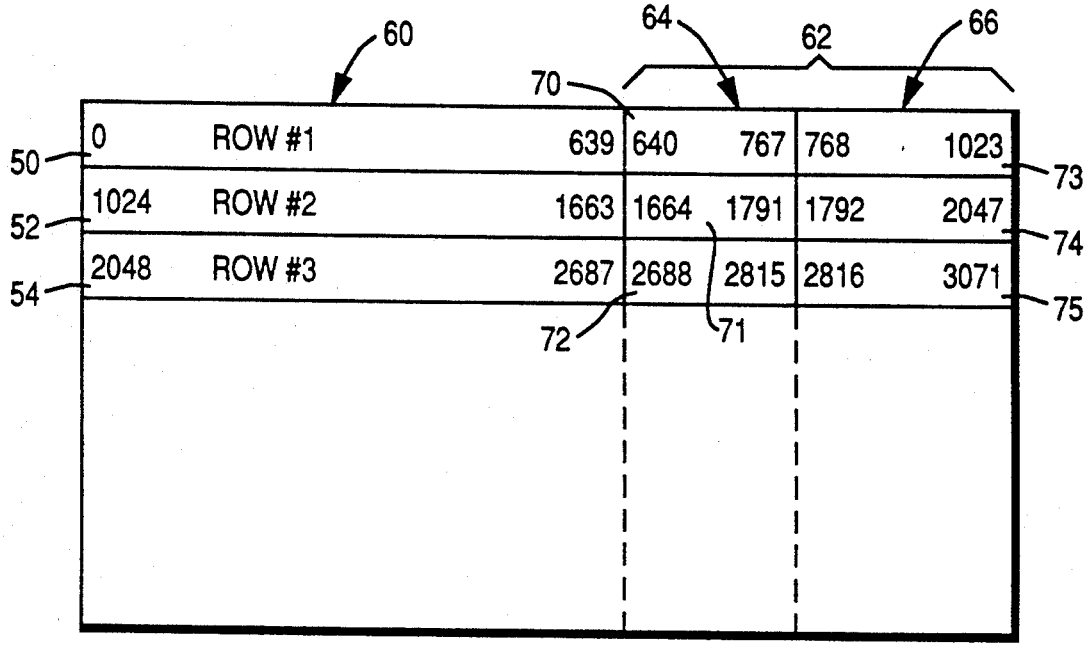
FIG. 2 is a diagram illustrating storage regions in a VRAM memory map.

In the videographics display system 10 of the preferred embodiment, a line on the monitor screen 38 (FIG. 1) consists of 640 pixels In a modified embodiment, a monitor screen line consists of 768 pixels. Since the next power of two greater than 640 is 1024, there are 384 positions per row in the VRAM 30 unused (redundant) for video information. Similarly, in the modified embodiment, there are 256 such unused (redundant) positions in each row. Referring to FIG. 2, there are shown schematically three rows of VRAM locations 50, 52 and 54 identified as row No. 1, row No. 2 and row No. 3 respectively. Thus, the VRAM memory map includes a region 60 for storing the video information, and a region 62 which, in the preferred embodiment, is not utilized for storing video information. The region 62 is shown as including regions 64 and 66, with the region 64 consisting of a region 70 containing bit positions 640 through 767 inclusive in row No. 1, and corresponding regions 71, 72 etc. in the subsequent rows, and the region 66 consisting of region 73 containing bit positions 768 through 1023 and corresponding regions 74, 75 etc. in the subsequent rows. It will be appreciated that the region 66 includes regions 73, 74 and 75 and the respective first, second and third rows which form dispersed storage regions in the memory map in that the last address 1023 in the first row region 73 is followed by an address gap (1024 to 1791) before the first address 1792 in the second row region 74, with a similar address gap existing between the storage region 74 and the storage region 75, etc.

Figure 3:
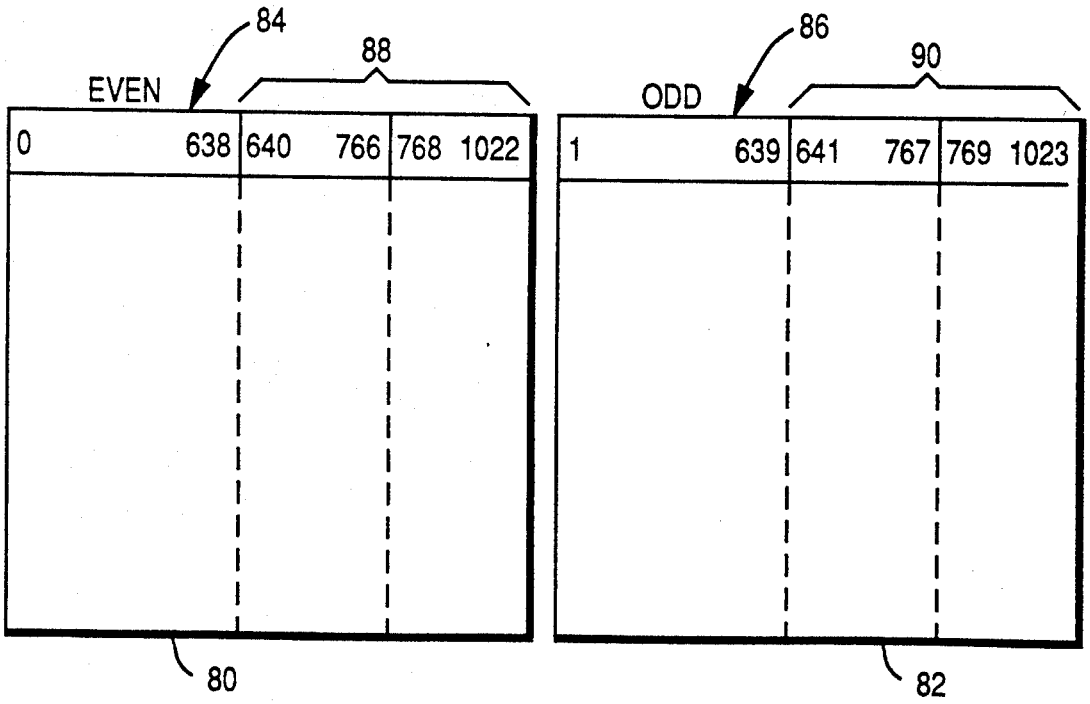
FIG. 3 is a diagram illustrating the use of individual VRAM memory device chips in a VRAM memory.

Referring briefly to FIG. 3, there is shown the physical arrangement of locations of row No. 1 in two one Mbit VRAM memory devices 80 and 82, wherein the device 80 stores the even numbered pixel positions and the device 82 stores the odd numbered pixel positions. This arrangement is required since the one Mbit devices utilized have 512 column locations. Thus, one VRAM row such as 50 (FIG. 2) is, in the preferred implementation, distributed over two VRAM devices 80, 82 as shown in FIG. 3. As further shown in FIG. 3, there is a video storage region consisting of region 84 in device 80 and region 86 in device 82, and a region, unused (redundant) for video storage consisting of region 88 in device 80 and region 90 in device 82. Since the multiplexing for accessing the two physical devices 80, 82 is readily implemented, and to avoid undue complication of the description of the preferred embodiment, it will be assumed that the VRAM rows are arranged as shown in the FIG. 2 memory map.

Figure 4:
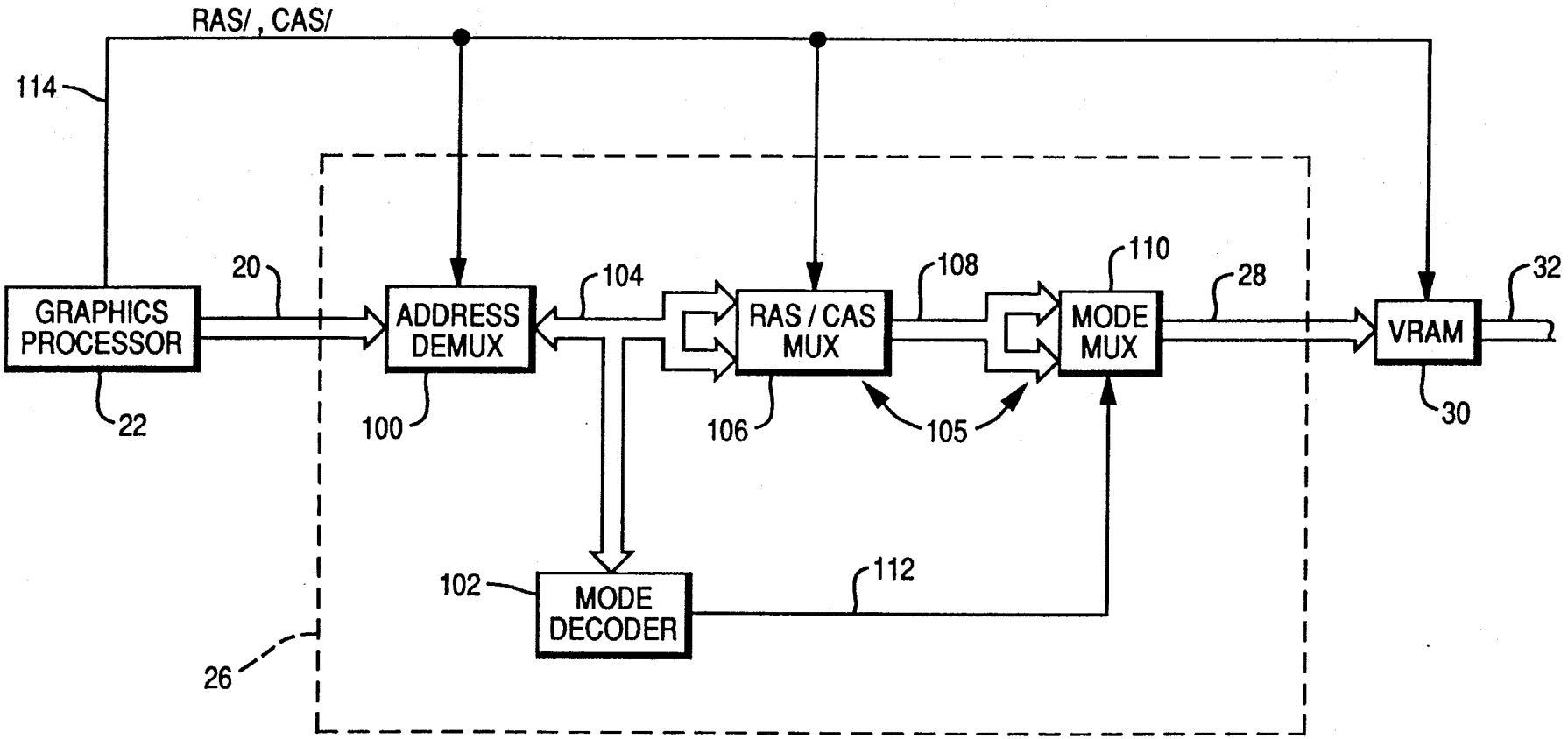
FIG. 4 is a block diagram showing the VRAM control unit included in the system of FIG. 1.

Referring now to FIG. 4, there is shown a block diagram of the VRAM control circuit 26. The 16-bit multiplexed local bus 20 is connected to an address demultiplexer 100. The addressed demultiplexer 100 is connected to a mode decoder 102 over a 32-bit bus 104 which is also connected to multiplexing means 105 including a RAS/CAS multiplexer 106, which is connected over a bus 108 to a mode multiplexer 110 also forming part of the multiplexing means 105. The mode multiplexer 110 receives a control input over a line 112 from the mode decoder 102. The output of the mode multiplexer 110 is connected over the bus 28 to the VRAM memory unit 30. Row and column address strobe signals RAS/, CAS/, which are active low, are supplied by the graphics processor 22 over a line 114 (which may be a line pair for the RAS/, CAS/ signals, respectively), to the address demultiplexer 100 and the RAS/CAS multiplexer 106, as well as the VRAM memory unit 30.

Figure 5:
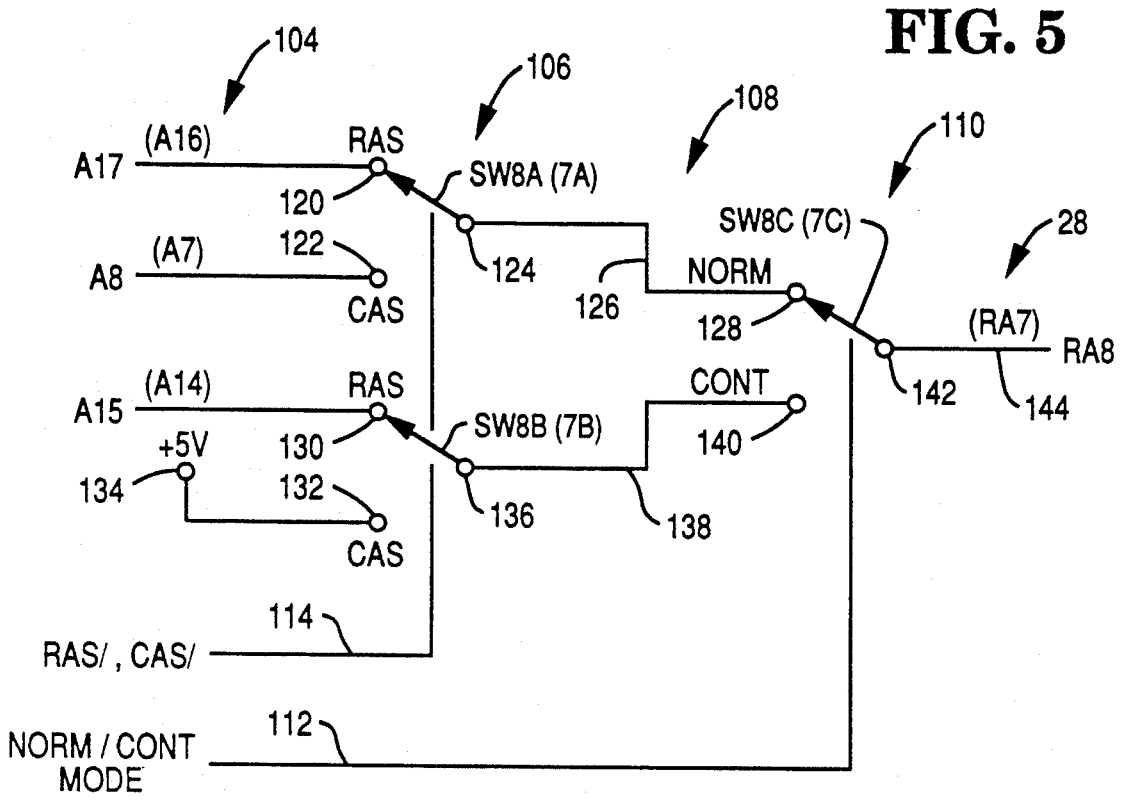
FIGS. 5 and 6 are diagrams illustrating the implementation of the two multiplexers shown in FIG. 4.
Figure 6:
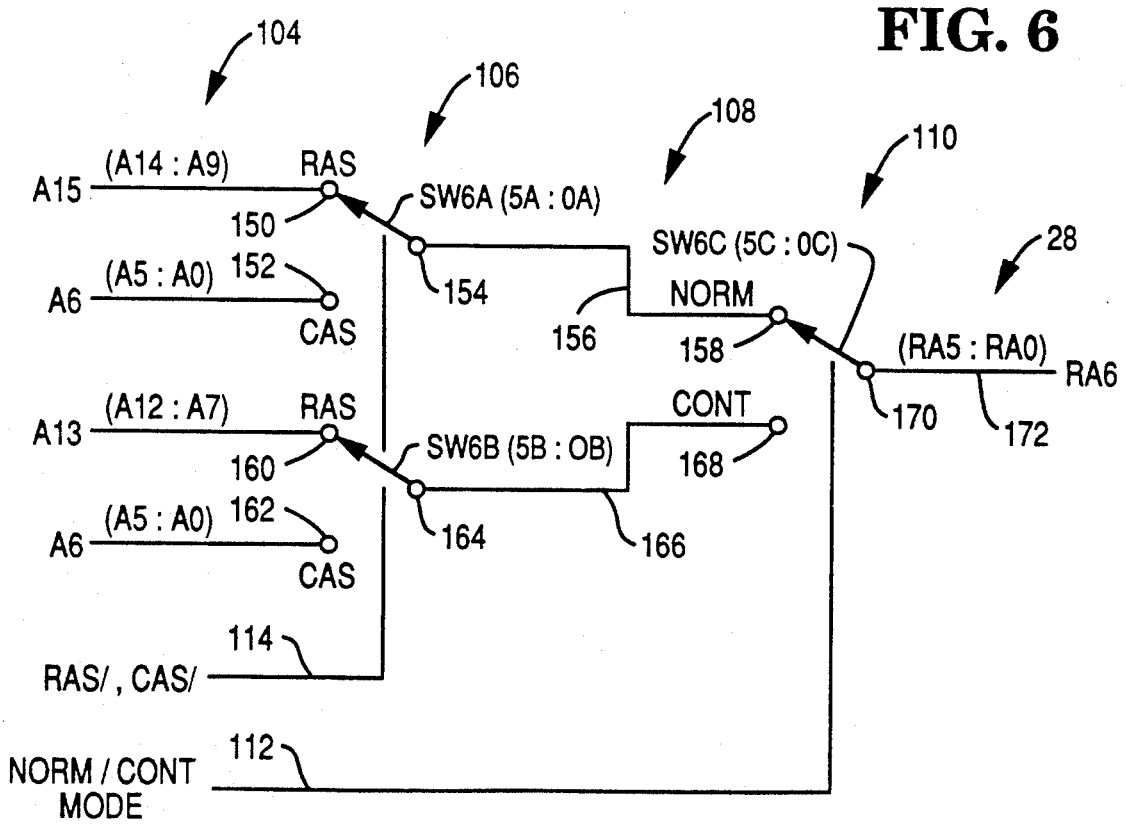

Referring now to FIGS. 5 and 6, there are shown more detailed diagrams of switching modules forming the multiplexers 106 and 110 (FIG. 4). It should be understood that the output bus 104 of the address demultiplexer 100 carries (inter alia) address bits A0–A8 at CAS (column address strobe) time and address bits A9–A17 at RAS (row address strobe) time, for addressing a column in a row of the VRAM memory shown in FIG. 2 (in practice, addressing individual VRAM memory chips 80 and 82 in a multiplexed manner, as mentioned in connection with the description of FIG. 3 hereinabove). In the preferred embodiment, RAS time occurs early in an addressing operation and CAS time occurs late in an addressing operation.

It should be understood that there are two switching modules corresponding to the FIG. 5 arrangement and seven switching modules corresponding to the FIG. 6 arrangement. Referring to FIG. 5, it will be seen that the RAS/CAS multiplexer 106 includes switches SW8A and SW8B which are controlled by the RAS/, CAS/ signals on line 114. The switch SW8A has a terminal 120 connected to receive address bit A17 from the bus 104 and a terminal 122 connected to receive address bit A8 from the bus 104. A terminal 124 is connected over a line 126 forming part of the bus 108 to a terminal 128 of a switch SW8C forming part of the mode multiplexer 110. The switch SW8B has a terminal 130 connected to receive address bit A15 from the bus 104 and a terminal 132 connected to a +5 V supply terminal 134. A terminal 136 is connected over a line 138 forming part of the bus 108 to a terminal 140 of the switch SW8C. The switch SW8C has a terminal 142 on which is supplied a signal RA8 on a line 144 forming part of the bus 28. The switch SW8C is operated under the control of the mode signal applied on the line 112.

It should be understood that a further switching module is provided, similar to that shown in FIG. 5, but having the connections and the identifications shown in parentheses in FIG. 5. Thus the further switching module includes switches SW7A, SW7B and SW7C, and has input lines connected to receive address bits A16, A7 and A14 and an output line providing the signal RA7.

Referring now to FIG. 6, the RAS/CAS multiplexer 106 includes switches SW6A and SW6B forming part of the RAS/CAS multiplexer 106, both of which are controlled by the RAS/,CAS/ signals on line 114. The switch SW6A has a terminal 150 connected to receive address bit A15 from the bus 104 and a terminal 152 connected to receive the address bit A6 from the bus 104. A terminal 154 is connected over a line 156 forming part of the bus 108 to a terminal 158 of a switch SW6C forming part of the mode multiplexer 110. The switch SW6B has a terminal 160 connected to receive address bit A13 from the bus 104 and a terminal 162 connected to receive address bit A6 from the bus 104. A terminal 164 is connected over a line 166 to a terminal 168 of the switch SW6C. The switch SW6C has a terminal 170 on which is supplied a signal RA6 on a line 172 forming part of the bus 28. The switch SW6C is operated under the control of the mode signal applied on line 112.

It should be understood that six other switching modules are provided, similar to that shown in FIG. 6 having the connections and identifications shown in parenthesis in FIG. 6. For example, reference SW6A (5A:0A) indicates that the six other switching modules include respective switches SW5A, SW4A, SW3A, SW2A, SW1A, and SW0A. It should be further understood that the apparatus described hereinabove is capable of operating in a selective one of two modes, that is, a normal mode, wherein the VRAM memory unit 30 is addressed for video information, and a contiguous mode, wherein the VRAM memory unit 30 is addressed for non-video information, such as program storage, message buffers, font-tables and the like.

Figure 7:
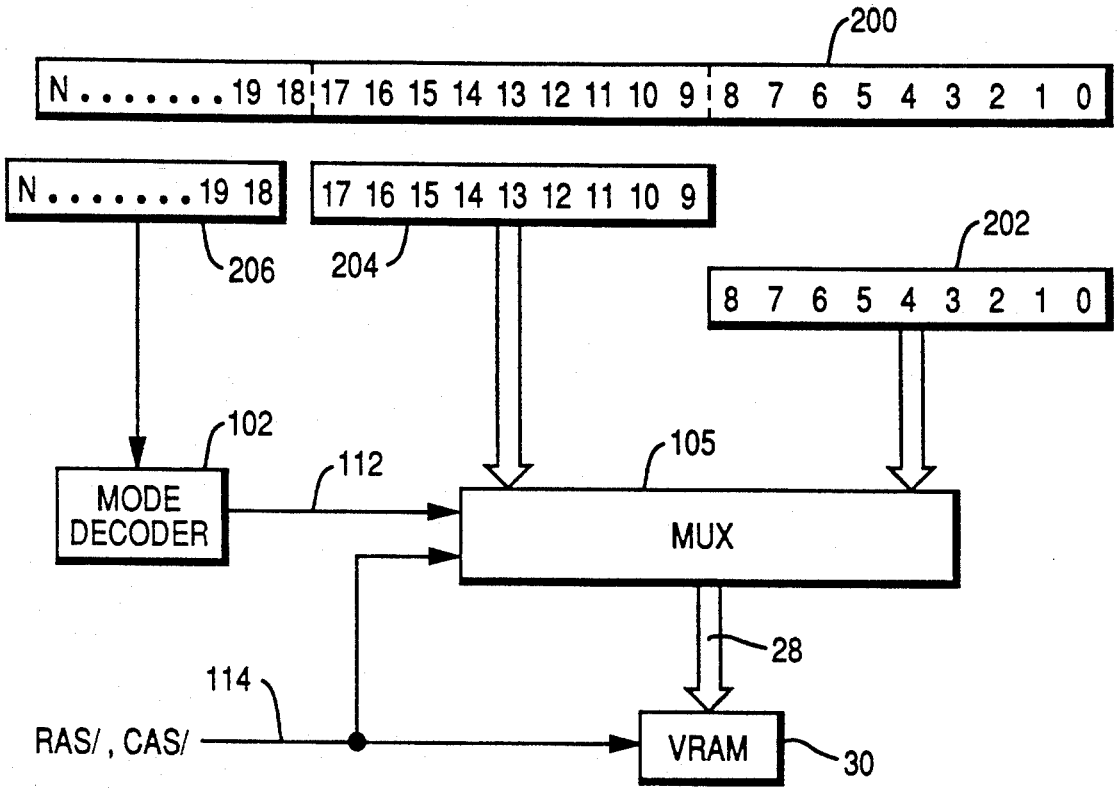
FIGS. 7 and 8 are diagrams helpful in understanding the VRAM memory addressing operation.

The normal operating mode will now be described with reference to FIG. 7 which illustrates VRAM addressing in the normal mode. A typical address utilized in the display system 10 is illustrated as address 200 in FIG. 7. Such address includes N+1 bits 0, . . . , N, of which the nine bits 0–8 represent a column address 202 and the nine bits 9–17 represent a row address 204. The higher order bits 206 are applied to the mode decoder 102. The total number of address bits is, of course, dependent on the overall memory capacity needed for the particular application. An operation, RAS (row address strobe) time, initiated by the signal RAS/, occurs early in the addressing operation, and CAS (column address strobe) time occurs late in the addressing cycle. Under the assumption that the mode decoder 102 provides a signal indicating the normal addressing mode, such signal is applied via the line 112 to the multiplexing means 105, which includes the RAS/CAS multiplexer 106 together with the mode multiplexer 110, described hereinabove. Referring also to FIGS. 5 and 6, in the normal operating mode, the nine switches SW8C to SW0C have their switch arms connected to the upper terminals, such as 128, 158, shown in FIGS. 5 and 6.

Early in the normal mode addressing operation, the RAS/ signal is active to cause the switches SW8A, SW8B to SW0A, SW0B to have their switch arms connected to the upper terminals 120, 130, 150 and 160. With these connections, it is seen that address bits A9 to A17 are directed by the multiplexing means 105 (FIG. 7) over the bus 28 to the VRAM memory unit 30 as a row address. Later in the normal mode addressing operation, the CAS/ signal is active to cause the switches SW8A, SW8B to SW0A and SW0B to change over their switch arms to connect with the lower terminals 122, 132, 152 and 162. With these connections, it will be seen that the nine address bits A0 to A8 are provided by the multiplexing means 105 to the VRAM memory unit 30 as a column address. Thus, in the normal operating mode for the preferred embodiment, the VRAM memory region 60 (FIG. 2) is addressed, since only the first 640 pixel positions in each row are utilized for video information. In the modified embodiment, discussed hereinabove, the VRAM memory regions 60 and 64 would be addressed for video information, utilizing the first 768 pixel positions.

Figure 8:
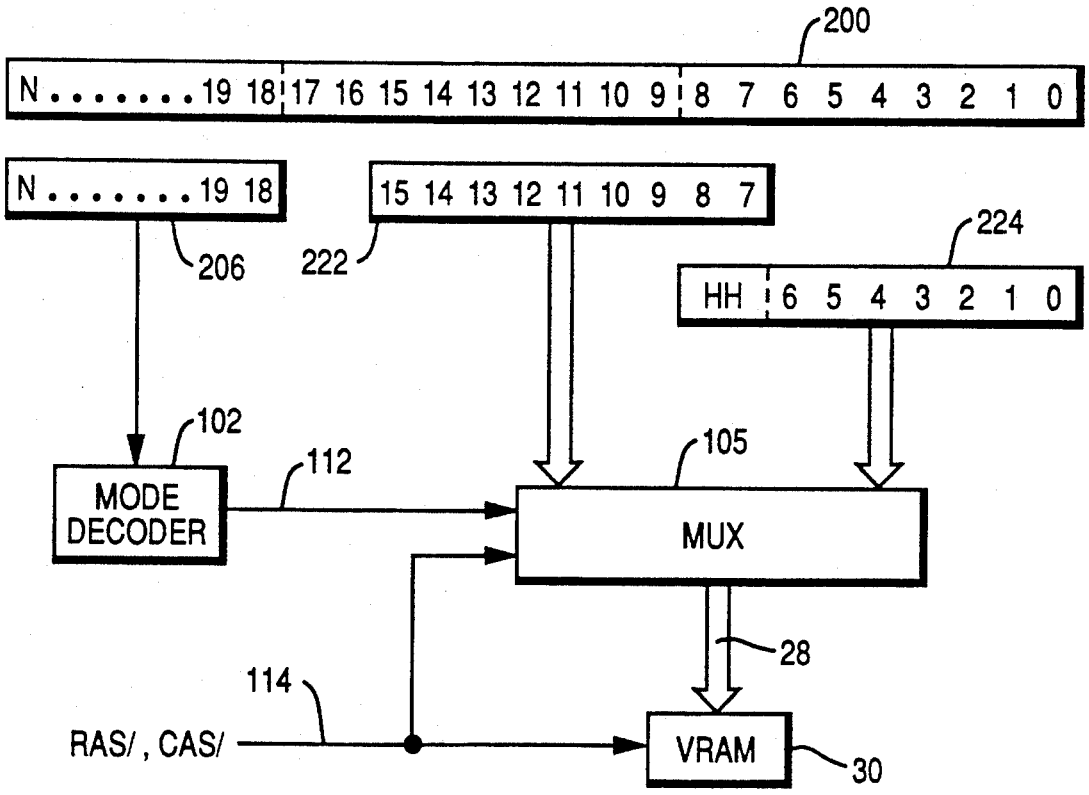

The contiguous operating mode will now be described with reference to FIG. 8, which illustrates VRAM addressing in the contiguous mode, wherein the mode decoder 102 provides a signal on the line 112 indicating the contiguous addressing mode. In the contiguous addressing mode, the switches SW8C to SW0C (FIGS. 5 and 6) have their switch arms connected to their lower terminals such as 140 and 168.

Early in the contiguous mode addressing operation, the RAS/ signal is active to cause the switches SW8A, SW8B to SW0A and SW0B (FIGS. 5 and 6) to have their switch arms connected to the upper terminals 120, 130, 150 and 160. With these connections, it will be seen that the nine address bits A7 to A15, indicated by reference 222 in FIG. 8 are directed via the multiplexing means 105 (FIG. 8) over the bus 28 to the VRAM memory unit 30 as a row address. Later in the contiguous mode addressing operation, the CAS/ signal is active to cause the switches SW8A, SW8B to SW0A and SW0B to change over their switch arms to connect with the lower terminals 122, 132, 152 and 162. With these connections, it will be seen that the multiplexing means 105 receives address bits A0 to A6 together with two high (H) address bits, that is "1" value bits, derived from the +5 V voltage source 134 (FIG. 5), at address bit positions A7 and A8. Thus the nine-bit address 224 (FIG. 8) is provided via the multiplexing means 105 and the bus 28 to the VRAM memory unit 30.

In summary, it will be appreciated that selection between normal memory mode operation and contiguous memory mode operation is effected by appropriate decoding of high order address bits in the mode decoder 102. For normal memory mode operation, the region 60 (FIG. 2), or in the modified embodiment the combined region 60 and 64, is selected for access. For the contiguous memory mode operation, the address bits 222 for row selection are in effect shifted two bits to the right and the address bits 224 for column selection have their two highest order positions held at a high or "1" level, thereby restricting access to the right-most quarter, i.e. region 66 (FIG. 2) of the VRAM memory unit 30. By referring to FIG. 8, it will seen that in the contiguous mode, bits A0 to A15 of the address bits 200 are utilized for address definition, and that successive (contiguous) addresses in this range address access successive bit positions in the memory region 66, whereby such region acts as a contiguous memory region, even though it is formed by dispersed regions in the map of the VRAM memory unit 30.

Figure 9:
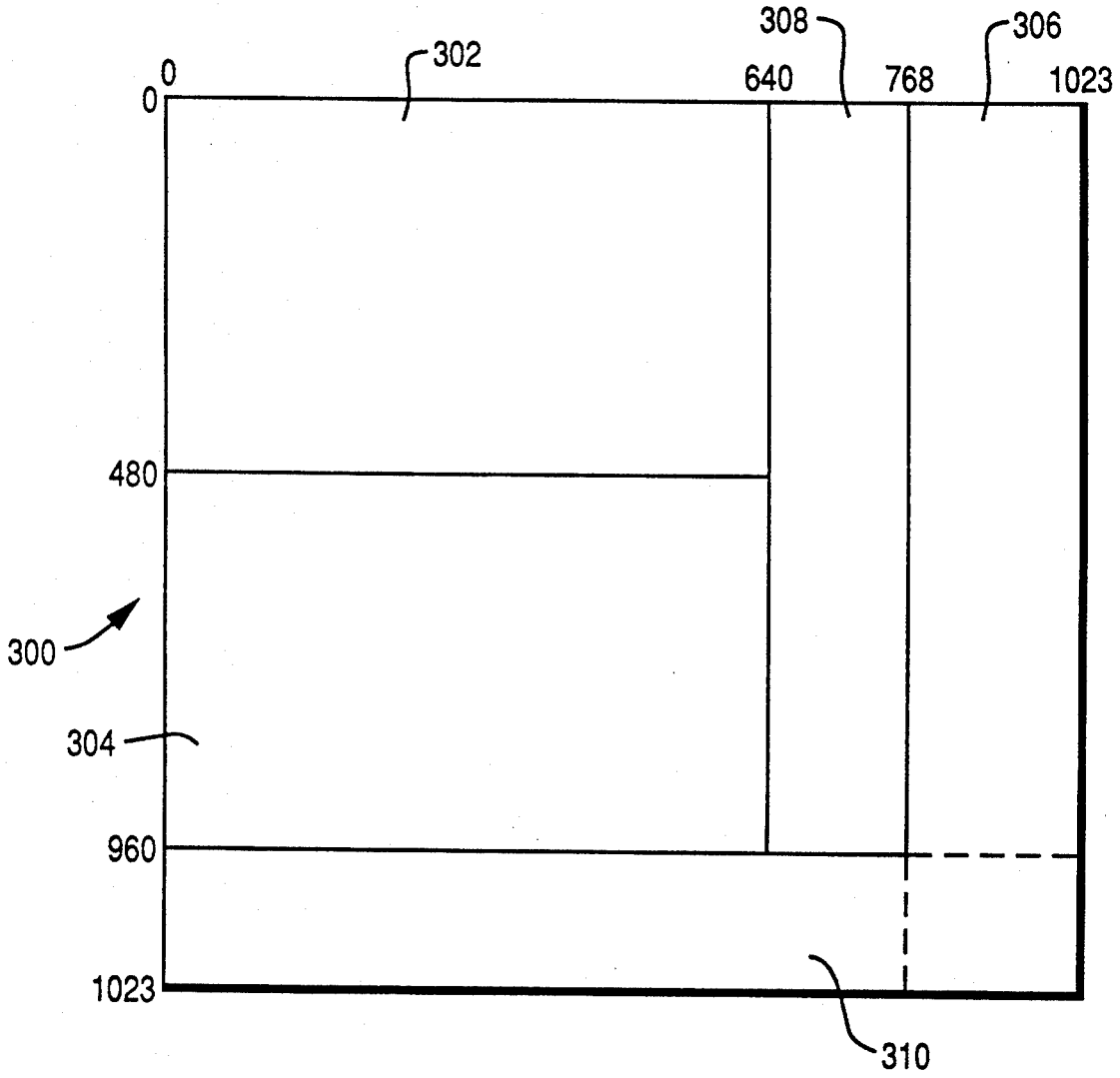
FIG. 9 is a memory map showing the utilization of a VRAM memory in an application of a system according to the present invention.

Referring now to FIG. 9, there is shown a memory map 300 of a VRAM memory in one application embodying the present invention, utilizing a plurality of individual VRAM devices (not shown), illustrating the storage of the information for two different 640 by 480 pixel screen pictures which can be displayed on the monitor 38 (FIG. 1). Thus the region 302 stores the video information for a first screen picture and the region 304 stores the video information for a second screen picture. It will be appreciated that in this application one screen picture can be displayed on the monitor 38 (FIG. 1) while the graphics processor 22 is processing the information for the other screen picture. The region 306 forms a contiguous memory region, addressable by contiguous addresses, and provides 256K bytes of additional memory for the graphics processor 22. The region 308 is an unused (redundant) memory area and the region 310 forms another unused memory area. Alternative arrangements are possible. For example, if the size of the contiguous memory region 306 were reduced to contain no more than the first 960 rows, then the area 310, representing the remaining rows from 960 to 1023, could be used as an additional storage area, utilizing the normal mode.

While the salient features of the invention have been illustrated and described, it should be readily apparent to those skilled in the art that many changes and modifications can be made in the invention presented without departing from the spirit and true scope of the invention. Accordingly, the present invention should be considered as encompassing all such changes and modifications of the invention that fall within the broad scope of the invention as defined by the claims.

What is claimed is:

1. A videographics display system including:

processing means adapted to control the operation of said display system;

video random access memory means adapted to store video data and non-video data dispersed from the video data by non-contiguous storage areas to be displayed;

monitor means adapted to provide a visual display of the stored data including memory control means coupled to said processing means and to said memory means and adapted to address said memory means in a first mode to access a first portion of said memory means which is adapted to store video data to be displayed on said monitor means and in a second mode to access a second portion of said memory means adapted to store non-video data, wherein said second portion includes storage locations dispersed in a plurality of dispersed storage locations in said memory means and wherein said memory control means is adapted to address said second portion of said memory means by means of contiguous addresses, said memory control means including means for generating first and second mode control signals for use in addressing contiguous memory locations in said first and second portions of said memory means, address demultiplexing means coupled to said processing means and adapted to provide memory addresses, a first multiplexer responsive to row and column strobe signals provided by said processing means, a second multiplexer responsive to said mode control signals, said first and second multiplexers coupled to said address demultiplexing means and adapted, in response to the generation of said first ode control signal, to selectively provide first address signals adapted to access said first portion of said memory means in response to the generation of said second mode control signal, to selectively provide second address signals adapted to access said second portion of said memory means, said first address signals including a first row address portion and a first column address portion, said second address signals including a second row address portion and a second column address portion, wherein the first predetermined bit positions of said second column address portion are constrained to be of a preselected value and wherein said second row address portion includes second predetermined bit positions corresponding in position in said memory addresses to said first predetermined bit positions, said first multiplexer including a plurality of first switching devices and a plurality of second switching devices wherein selected ones of said plurality of second switching devices have respective terminals thereof coupled to a predetermined reference potential and said second multiplexer includes a plurality of third switching devices having respective terminals thereof coupled to respective terminals of said first and second switching devices.

2. A video graphics display system according to claim 1 in which said generating means includes mode decoding means coupled to said processing means and adapted to provide said first and second mode control signals in dependence on said memory addresses and said row and column strobe signals.

3. A videographics display system according to claim 2 in which said dispersed storage regions include corresponding locations in respective rows of said memory means.

* * * * *

UNITED STATES PATENT AND TRADEMARK OFFICE

CERTIFICATE OF CORRECTION

PATENT NO. : 5,231,383

DATED : July 27, 1993

INVENTOR(S) : Wilhelmus J.M. Diepstraten et al.

It is certified that error appears in the above-identified patent and that said Letters Patent is hereby corrected as shown below:

Column 7, line 18, "ode" should be --mode--.

Signed and Sealed this

Eighth Day of March, 1994

*Attest:*

*Attesting Officer*

Bruce Lehman

BRUCE LEHMAN

*Commissioner of Patents and Trademarks*